US005190722A

United States Patent [19]

Saito et al.

[11] Patent Number: 5,190,722

[45] Date of Patent: Mar. 2, 1993

[54] HIGH COLD-FORGING ELECTROMAGNETIC STAINLESS STEEL

[75] Inventors: Yoshinobu Saito; Makoto Tabei; Yasuhide Ouchi, all of Sendai; Jun Takizawa, Wako; Hitoshi Itami, Wako; Yoshiaki Takagi, Wako, all of Japan

[73] Assignees: Tohoku Special Steel Works Limited, Sendai; Honda Giken Kogyo Kabushiki Kaisha, Tokyo, both of Japan

[21] Appl. No.: 814,621

[22] Filed: Dec. 30, 1991

[30] Foreign Application Priority Data

Dec. 28, 1990 [JP] Japan ..... 2-418092

[51] Int. Cl.[5] ..... C22C 38/28; C22C 38/32

[52] U.S. Cl. ..... 420/40; 420/41; 420/42; 420/63

[58] Field of Search ..... 420/40, 41, 42, 63, 420/64; 148/32 S

[56] References Cited

U.S. PATENT DOCUMENTS

| | | | |
|---|---|---|---|
| 3,852,063 | 12/1974 | Niimi et al. | 420/64 |
| 4,434,006 | 2/1984 | Kato et al. | 420/42 |
| 4,714,502 | 12/1987 | Honkura et al. | 420/41 |

FOREIGN PATENT DOCUMENTS

| | | | |
|---|---|---|---|
| 2153186 | 5/1973 | Fed. Rep. of Germany . | |
| 54-17291 | 6/1979 | Japan . | |
| 60-29449 | 2/1985 | Japan | 420/63 |
| 60-48584 | 10/1985 | Japan . | |

*Primary Examiner*—Deborah Yee
*Attorney, Agent, or Firm*—Young & Thompson

[57] ABSTRACT

A high cold-forging electromagnetic stainless steel comprises not more than 0.02 wt. % of C, not more than 0.50 wt. % of Si, not more than 0.50 wt. % of Mn, 10.0–18.0 wt. % of Cr, 0.30–1.50 wt. % of Mo, 0.05–0.50 wt. % of Ti, 0.30–2.00 wt. % of Al, 0.0005–0.05 wt. % of B, not more than 0.05 wt. % of N and the balance being substantially Fe. This steel may further contain a given amount of at least one of Nb, V, Pb, Ca, Se, S and REM. Such stainless steel is used as a material of parts in an electronically controlled fuel injection system.

9 Claims, 6 Drawing Sheets

Steel a (900°C)

x100

Steel c (700°C)

x100

HIGH COLD-FORGING ELECTROMAGNETIC STAINLESS STEEL

BACKGROUND OF THE INVENTION

1. Field of the Invention

This invention relates to high cold-forging electromagnetic stainless steels having an excellent cold forging property and good soft magnetic properties and corrosion resistance, which are particularly suitable as a valve housing material, a valve sleeve or a valve core material of an electronically controlled fuel injection system for automobiles.

2. Description of the Related Art

The electronically controlled fuel injection system for automobile is widely used in many automotive vehicles with rapid advancement of car electronics. As a material for parts constituting this system, 13Cr-1Si-Al ferritic stainless steels are practically and frequently used from a viewpoint of demands on corrosion resistance and soft magnetic properties.

In order to reduce the cost for working these parts, the working is switching over from cutting work to cold forging work, and particularly it is directed to all work these parts through the cold forging.

Under such a circumstance, it has hitherto been attempted to improve the cold forging property by reducing amounts of (C+N) in the above 13Cr-1Si-Al alloy steel.

However, the shape of the parts used in the electronically controlled fuel injection system is very complicated, so that the effect by the reduction of (C+N) amount is still insufficient even in the existing 13Cr-1Si-Al alloy steel.

On the other hand, the use of alcohol fuel is earnestly examined with the diversification of automobile fuel. In this case, the occurrence of corrosion accompanied with the formation of acetic acid or formic acid by oxidation of alcohol is feared. Furthermore, it is required to have a corrosion resistance to chloride through snow melting agent used in winter season.

Moreover, the material used for the electronically controlled fuel injection system is particularly required to have soft magnetic properties. The improvement of such magnetic properties directly connects to the improvement of characteristics in the electronically controlled fuel injection system.

As mentioned above, the properties required in the material used for the electronically controlled fuel injection system extend over a wide area and interrelate to each other. In many cases, these properties are conflicting with each other.

SUMMARY OF THE INVENTION

The inventors have made various studies in order to solve the above problems and found that when Ti and B are added together to an electromagnetic ferritic stainless steel, the effect by the reduction of C, N amounts is improved in the resulting alloy steel and crystal grains are finely screened through annealing of matrix before cold forging to effectively control the formation of coarse crystal grain and also when Nb and V are added to the above alloy steel, they effectively act to C, N to reduce C, N soluted in the matrix and consequently the susceptibility to cracking in cold forging is largely improved and hence the cold forging property of the alloy steel is considerably improved.

Furthermore, it has been found that the simultaneous addition of Ti and B widens the temperature range showing good magnetic properties in a product and forms relatively fine and uniform crystal grain structure to improve the soft magnetic properties, and also the simultaneous addition of Ti, Mo largely improves the corrosion resistance.

The invention is based on the above knowledges.

According to the invention, there is the provision of a high cold-forging electromagnetic stainless steel consisting essentially of not more than 0.02 wt % of C, not more than 0.50 wt % of Si, not more than 0.50 wt % of Mn, 10.0–18.0 wt % of Cr, 0.30–1.50 wt % of Mo, 0.05–0.50 wt % of Ti, 0.30–2.00 wt % of Al, 0.0005–0.05 wt % of B, not more than 0.05 wt % of N and the balance being substantially Fe.

In a preferred embodiment of the invention, the stainless steel further contains at least one of not more than 1.0 wt % of Nb and not more than 1.0 wt % of V and/or at least one of 0.03–0.3 wt % of Pb, 0.002–0.03 wt % of Ca, 0.01–0.2 wt % of Se and 0.01–0.20 wt % of S and/or 0.0005–0.01 wt % of REM.

BRIEF DESCRIPTION OF THE DRAWINGS

The invention will be described with reference to the accompanying drawings, wherein.

DESCRIPTION OF THE PREFERRED EMBODIMENTS

The invention will be described with respect to experimental results resulting in the success of the invention.

As a test steel, there were used three kinds of steels having the following composition:

a) steel comprising C: 0.008 wt % (hereinafter shown by % simply), Si: 0.15%, Mn: 0.20%, Cr: 13.55%, Mo: 0.50%, Ti: 0.11%, Al: 0.785%, B: 0.011%, N: 0.015% and the balance being substantially Fe (Ti, B added steel);

b) steel comprising C: 0.008%, Si: 0.14%, Mn: 0.22%, Cr: 13.63%, Mo: 0.49%, Ti: 0.092%, Al: 0.736%, B: 0.0003%, N: 0.017% and the balance being substantially Fe (Ti added steel); and c) steel comprising C: 0.006%, Si: 0.15%, Mn: 0.22%, Cr: 13.46%, Mo: 0.49%, Ti: 0.003%, Al: 0.751%, B: 0.0002%, N: 0.014% and the balance being substantially Fe (steel containing no Ti, B).

Five kg of each of these test steels was induction-melted under an argon gas atmosphere to prepare an ingot of 65 mm in diameter. Then, the ingot was hot-forged at 1050° C. to form a rod of 15 mm in diameter, which was cold rolled to obtain a test steel of 13 mm in diameter.

The crystal grain size, hardness, crack limit working ratio, deformation resistance and magnetic properties were measured with respect to the thus obtained test steels to obtain results shown in FIGS. 1 to 5.

Figure 1:
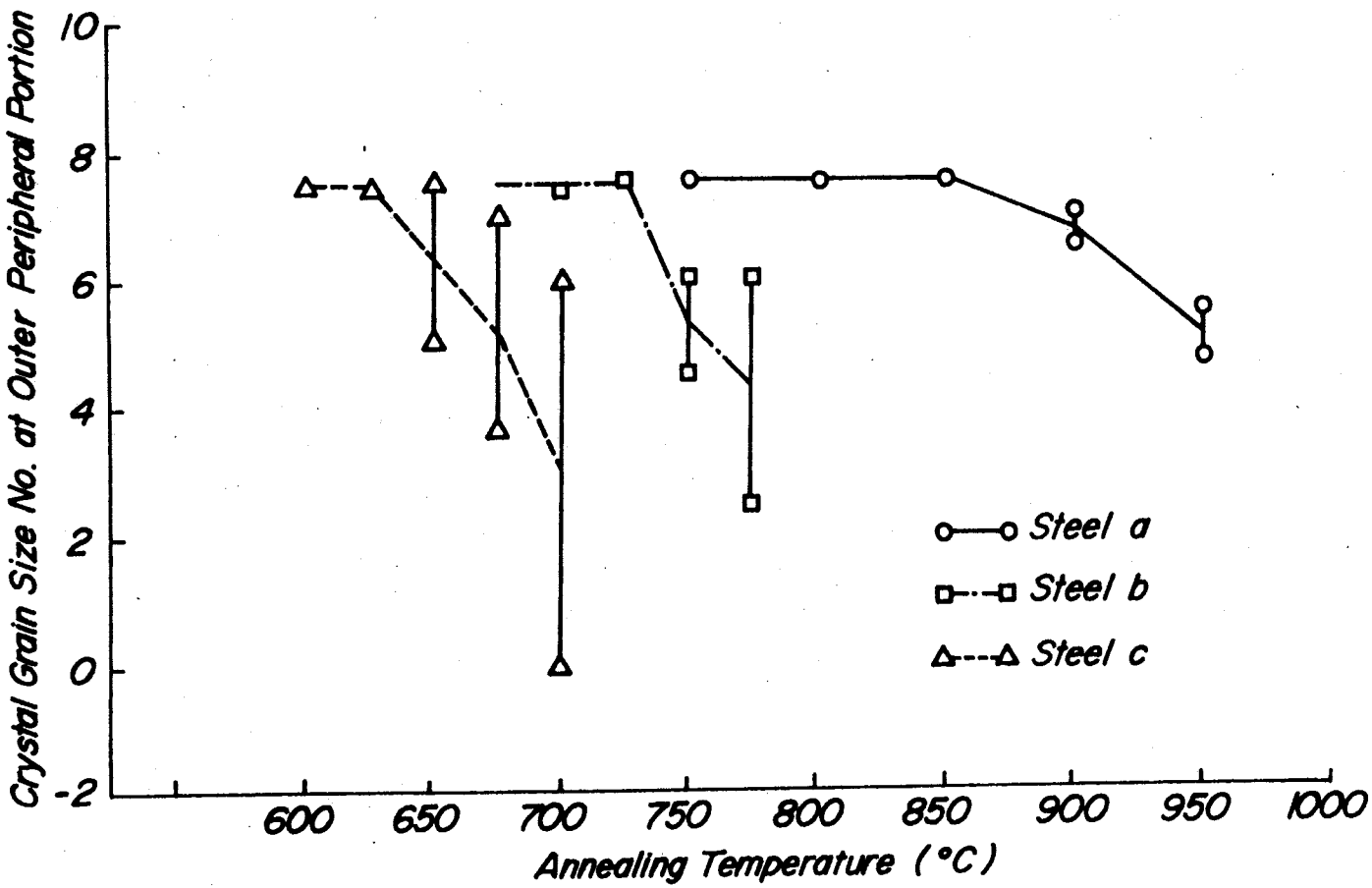
FIG. 1 is a graph showing a relation between annealing temperature and crystal grain size.

In FIG. 1 is shown a relation between annealing temperature and crystal grain size, from which the followings are found out. That is, in the steel c containing no Ti and B, duplex grains are caused at an annealing temperature of 650° C., and when No. 4 or more capable of conducting cold forging is selected as a crystal grain size, there is a risk of causing intergranular cracking at the cold forging even after the annealing at 675° C. In the steel b containing only Ti of about 0.1%, the crystal grains tend to be made fine, but the formation of duplex grains can not be avoided and crystal grains of No. 3 or less are observed at 775° C.

On the contrary, in the steel a containing Ti of about 0.1% and B of about 0.01%, fine crystal grain size is maintained at a higher annealing temperature and screened relatively uniformly.

Figure 2:
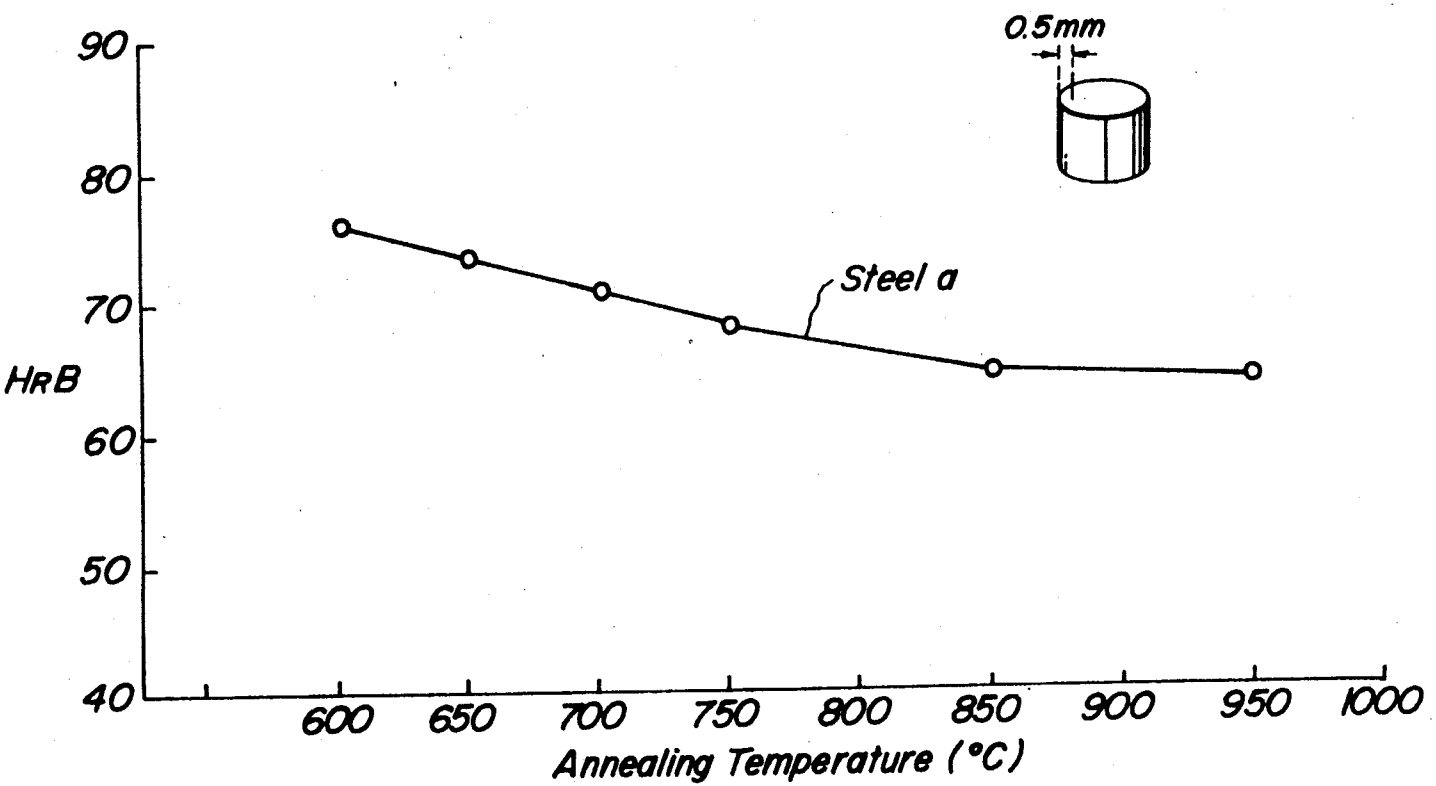
FIG. 2 is a graph showing a relation between annealing temperature and hardness.

In FIG. 2 is shown a relation between annealing temperature and hardness in the steel a, from which it is apparent that the hardness monotonously lowers together with the increase of the annealing temperature when the test steel is maintained at a given annealing temperature for two hours and then cooled in a furnace.

Figure 3:
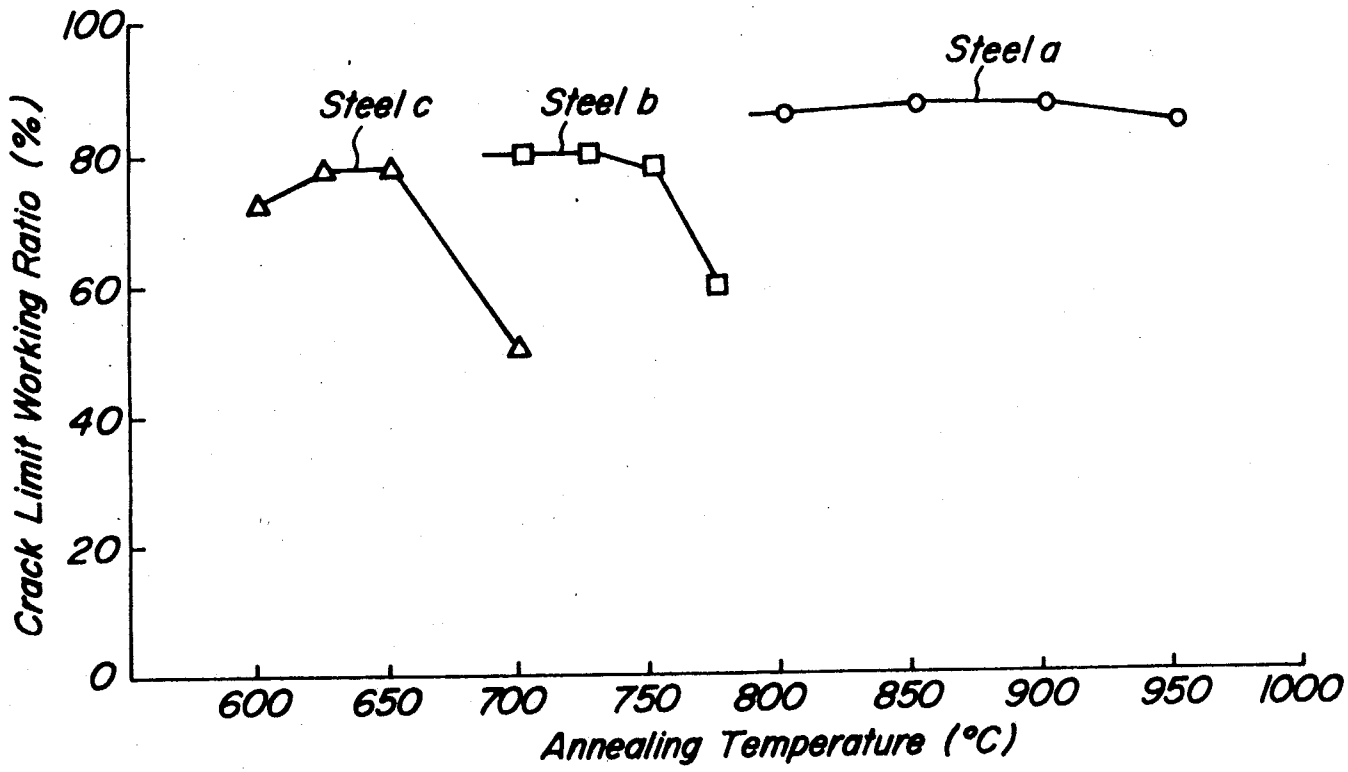
FIG. 3 is a graph showing a relation between annealing temperature and crack limit working ratio.

In FIG. 3 is shown a relation between annealing temperature and crack limit at cold working, from which it is confirmed that the annealing temperature range capable of working without cracking is widened up to a higher temperature by the addition of Ti, B and also the crack limit working ratio is possible to be raised up to a higher level.

Figure 4:
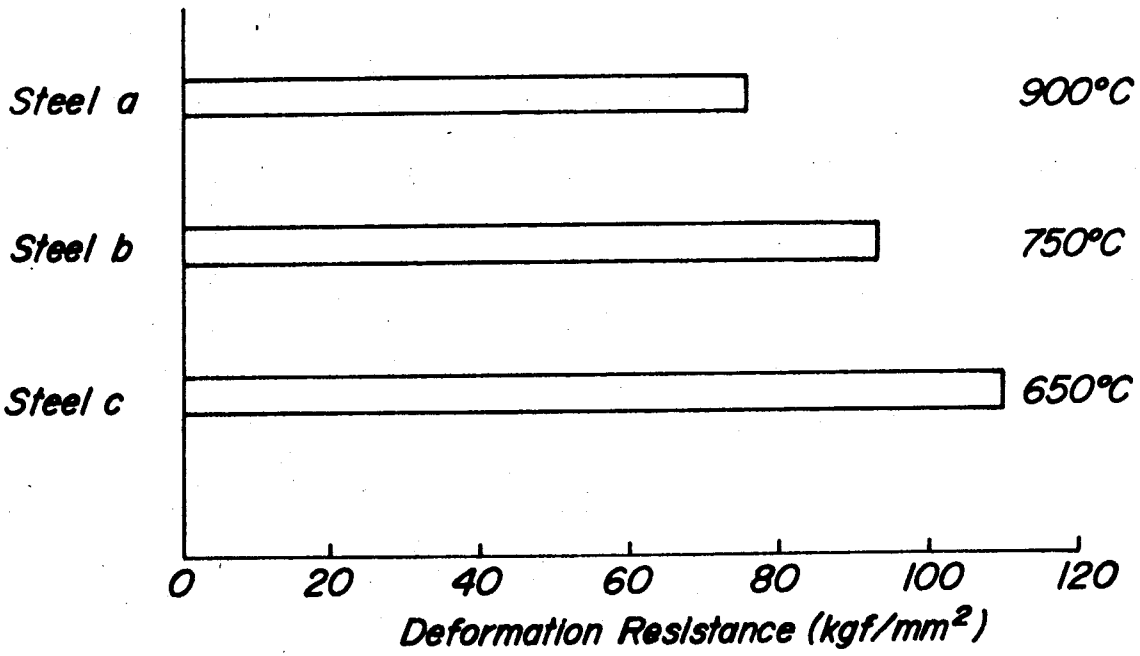
FIG. 4 is a graph showing a difference in deformation resistance among steels a to c.

In FIG. 4 is shown compressive deformation resistance of each of the test steels when a cold working ratio is 80%, from which it is obvious that the steel a containing Ti and B is low in the deformation resistance as compared with the steel b containing only Ti and the steel c containing no Ti and B.

Figure 5:
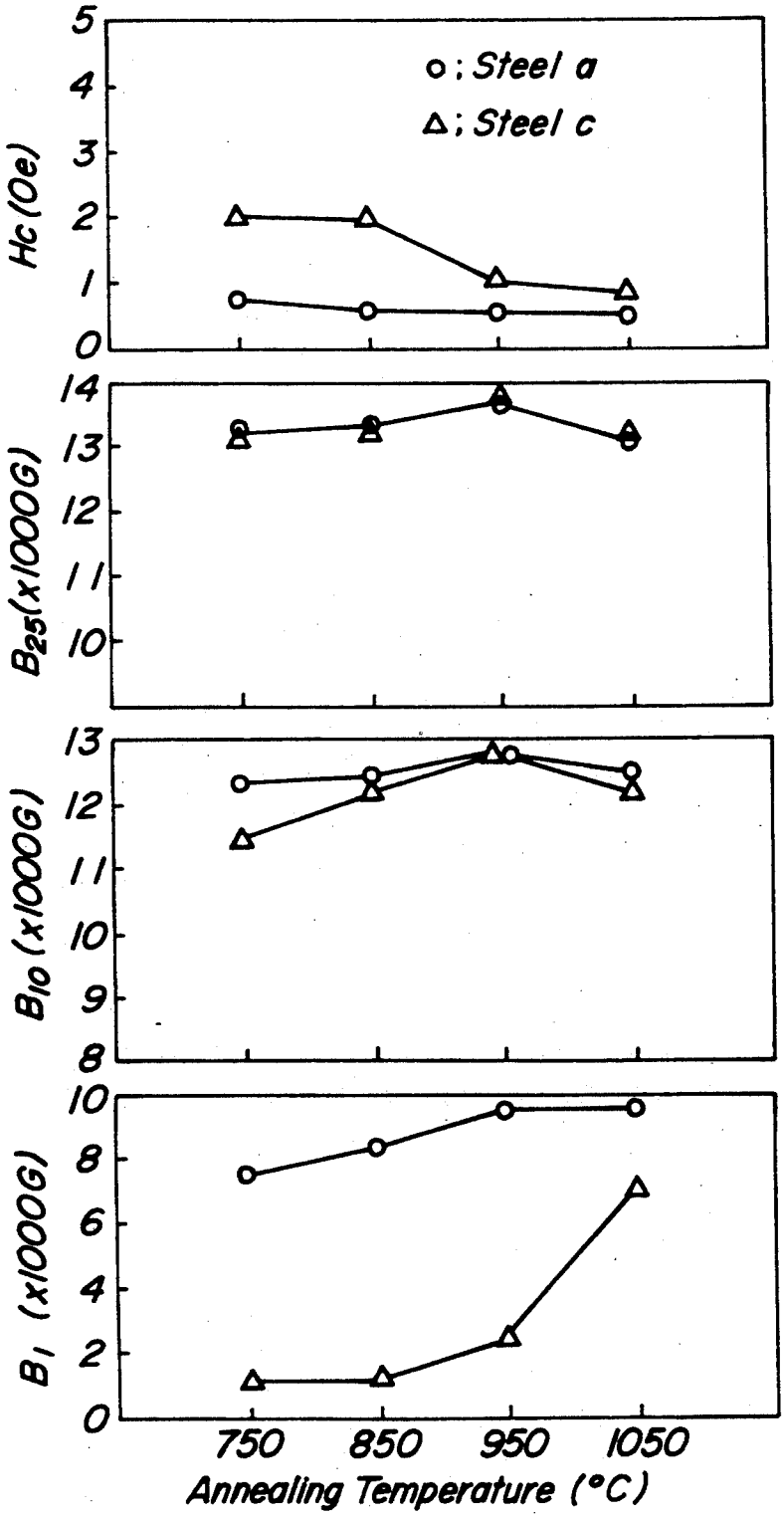
FIG. 5 is a graph showing a relation of annealing temperature to magnetic properties.

In FIG. 5 is shown a relation of annealing temperature to magnetic properties in the steels a and c. In the steel a, good magnetic properties are exhibited over a wide temperature range. On the other hand, in the steel c, the improvement of magnetic properties is observed at a temperature above 950° C., but the structure tends to be course at this temperature.

Figure 6A:
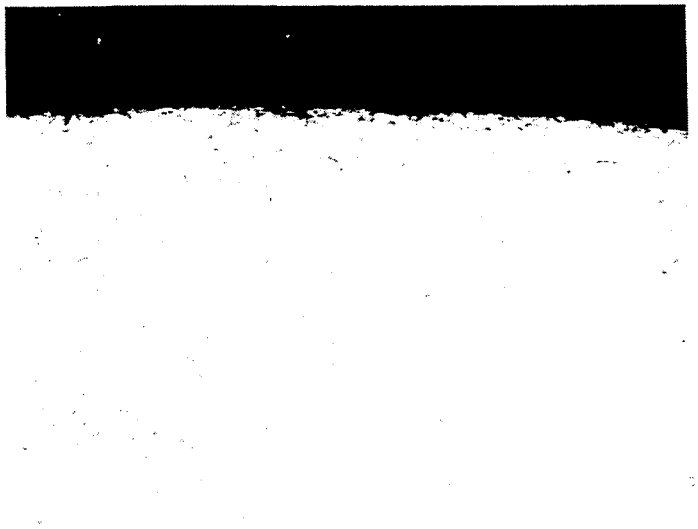
FIGS. 6*a* and 6*b* are microphotographs showing metallic structures of steels a and c after annealing at 900° C. and 700° C., respectively.
Figure 6B:
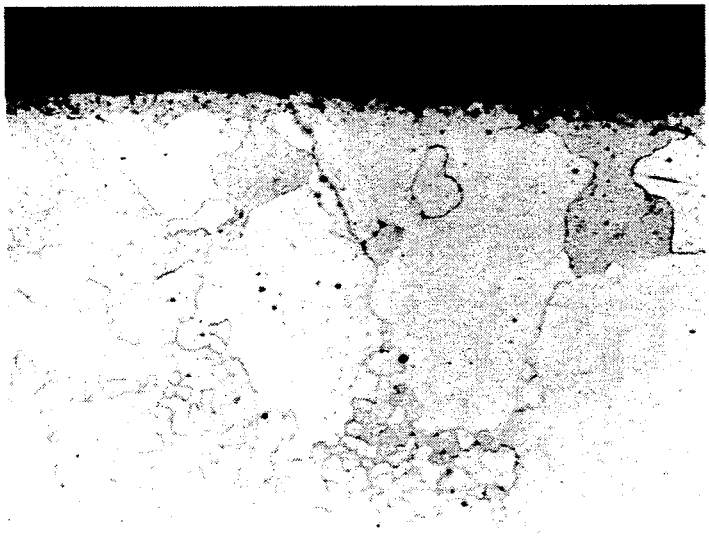

In FIGS. 6*a* and 6*b* are shown microphotographs of metallic structure in the steel a after the annealing at 900° C. and the steel c after the annealing at 700° C., respectively.

As seen from FIGS. 6*a* and 6*b*, the steel a shows a screening of about 7.5 in the crystal grain size, while 2–3 abnormally coarsened grains are observed in the outer peripheral portion of the steel c.

As mentioned above, the fine screened structure is obtained by simultaneously adding Ti and B, and the remarkable improvement of cold forging property and magnetic properties is attained as compared with the conventional steels.

The reason why the alloying composition is limited to the above range in the invention will be described below.

C: not more than 0.02%

C is an element considerably degrading the corrosion resistance, magnetic properties and cold forging property in stainless steel, so that it is desirable to reduce C amount as far as possible. However, C is inevitably incorporated into steel in the production of the stainless steel. Therefore, the C amount is restricted to not more than 0.02% from a viewpoint of actual operation.

Si: not more than 0.50%

Si is useful as a deoxidizer in steel and effectively contributes to improve the magnetic properties of ferritic stainless steel. Furthermore, Si is useful for increasing electrical resistance to improve a response characteristic at high frequency region, but considerably increases the hardness to arrest the cold forging property.

In the invention, therefore, the Si amount is restricted to not more than 0.50% (preferably not less than 0.01%) from a viewpoint of the cold forging property.

Mn: not more than 0.50%

Mn is an element effective as a deoxidizer in stainless steel, but arrests the magnetic properties, so that the Mn amount is restricted to not more than 0.50% (preferably not less than 0.01%).

Cr: 10.0–18.0%

Cr is a main component in the steel according to the invention and is a most effective element for corrosion resistance, magnetic properties and electrical resistance. Particularly, when Cr is existent together with Mo and Ti, very excellent corrosion resistance is maintained and the magnetic properties are good. When the Cr amount is less than 10.0%, the above effect is poor, while when it exceeds 18.0%, the degradation of not only magnetic properties (particularly magnetic flux density) but also the cold forging property is caused, so that the Cr amount is restricted to a range of 10.0–18.0%.

Mo: 0.30–1.50%

Mo considerably improves the corrosion resistance in the coexistence with Cr and Ti. When a small amount of Mo is added, the coercive force (Hc) of the steel according to the invention is largely improved. However, when it is less than 0.30%, the effect is not conspicuous, while when it exceeds 1.505, the cold forging property is degraded and the cost becomes expensive. Therefore, the Mo amount is restricted to a range of 0.30–1.50%.

Ti: 0.05–0.50%

Ti is a most important element in the steel according to the invention together with B. Ti effectively acts to C, N in steel together with B, whereby crystal grains is finely screened before the cold forging to considerably improve the cold forging property. Furthermore, Ti acts to finely and uniformly disperse C, N, which contributes to improve the magnetic properties. Moreover, Ti has an effect of remarkably improving the corrosion resistance, particularly corrosion resistance to chloride in the coexistence with Mo.

When the Ti amount is less than 0.05%, the effect is insufficient, while when it exceeds 0.50%, the effect is saturated and troubles are rather caused in the production, so that the Ti amount is restricted to a range of 0.05–0.50%.

Al: 0.30–2.00%

Al is an element useful for improving the magnetic properties together with Si in the steel and effectively increasing the electrical resistance to improve the responsibility at high frequency region, and is low in the contribution to the increase of hardness as compared with Si.

However, when the Al amount is less than 0.30%, the effect of improving the magnetic properties is insufficient, while when it exceeds 2.00%, not only a special refining process is required but also the cold forging property is obstructed, so that the Al amount is restricted to a range of 0.30–2.00%.

B: 0.0005–0.05%

B is an important element together with Ti in the steel according to the invention, which effectively acts to C, N in the steel to improve the magnetic properties and also makes the crystal grain size fine to effectively contribute to the improvement of the cold forging property. However, when the B amount is less than 0.0005%, the effect is unsatisfactory, while when it exceeds 0.05%, the hot and cold workabilities are obstructed, so that the B amount is restricted to a range of 0.0005–0.05%.

N: not more than 0.05%

N is an element considerably degrading the corrosion resistance, magnetic properties and cold forging property in stainless steel likewise C, so that it is desirable to reduce the N amount as far as possible. In this connection, the amount of not more than 0.05% is accepted.

Although the above is described with respect to the basic components, according to the invention, at least one of Nb and V may be added in order to include the toughness and improve the cold forging property and magnetic properties. Further, at least one of Pb, Ca, Se and S may be added in order to include the cutting property, and Rem may be added in order to more improve the cold forging property.

The invention will be described with respect to these auxiliary components.

Nb: not more than 1.0%, V: not more than 1.0%

Nb and V are useful for improving the toughness of the steel according to the invention and effectively contribute to improve the cold forging property and magnetic properties. When the amount of each of these elements exceeds 1.0%, the cold forging property is degraded, so that the amount is restricted to not more than 1.0%.

Pb: 0.03–0.3%, Ca: 0.002–0.03%, Se: 0.01–0.2%, S: 0.01–0.20%

All of Pb, Ca, Se and S are elements useful for improving the cutting property of the steel according to the invention. In order to obtain the given effect, each of these elements is required to be added in an amount larger than the above defined lower limit. However, when the amount exceeds the upper limit, the corrosion resistance, magnetic properties and cold forging property are degraded.

REM (lanthanoids): 0.0005–0.01%

It can be attempted to more improve the cold forging property by the addition of REM. For this purpose, it is required to add REM in an amount of at least 0.0005%. However, when the amount exceeds 0.01%, it is required to use a special melting and refining process and the cost becomes expensive, so that the Rem amount is restricted to a range of 0.0005–0.01%.

The following examples are given in illustration of the invention and are not intended as limitations thereof.

Five kg of each of test steels (No. 1–No. 17) having various compositions as shown in Table 1 was induction melted in an Ar gas atmosphere to prepare an ingot of 65 mm in diameter. Then, the ingot was hot forged at 1050° C. to form a rod of 15 mm in diameter, which was cold rolled to obtain a test steel specimen of 13 mm in diameter.

The cold forging property, magnetic properties, electrical resistance and corrosion resistance were measured with respect to the thus obtained test steel specimens as mentioned below.

The measured results are shown in table 2.

The cold forging property was evaluated by preparing a test sample of 6 mm diameter × 11 mm height and subjecting to a compression test through a hydraulic press to measure crack limit working ratio and deformation resistance at compression of 80%.

As to the magnetic properties, after a ring sample of 10 mm in outer diameter × 5.5 mm in inner diameter × 5 mm in thickness was prepared and annealed at 750°–1050° C., the direct current magnetic properties were measured by means of B-H loop tracer.

The electrical resistance was measured by means of a digital voltmeter after the test sample was cold drawn to 1 mm in diameter and annealed at 850° C. under vacuum.

The corrosion resistance was evaluated by the presence or absence of rusting when a test sample of 8 mm in diameter × 80 mm was prepared, polished with a sand paper of No. 500 and subjected to a salt spray test with an aqueous solution of 5% NaCl at 35° C. for 96 hours. Furthermore, a test sample of 13 mm in diameter × 5 mm was prepared, polished with a sand paper of No. 800 and immersed in an aqueous solution of 3.5% NaCl at 30° C. to measure a pitting potential.

TABLE 1

| No. | C | Si | Mn | Cr | Mo | Ti | Al | B | N | Nb | V | Pb | S | Ca | Se | MM | Ce | La |
|---|---|---|---|---|---|---|---|---|---|---|---|---|---|---|---|---|---|---|
| Acceptable steel | | | | | | | | | | | | | | | | | | |
| 1 | 0.008 | 0.15 | 0.20 | 13.55 | 0.50 | 0.11 | 0.785 | 0.011 | 0.015 | | | | | | | | | |
| 2 | 0.002 | 0.02 | 0.42 | 10.06 | 1.00 | 0.22 | 1.951 | 0.008 | 0.014 | | | | | | | | | |
| 3 | 0.006 | 0.48 | 0.19 | 13.58 | 0.98 | 0.22 | 0.062 | 0.011 | 0.017 | | | | | | | | | |
| 4 | 0.018 | 0.14 | 0.19 | 13.43 | 0.49 | 0.46 | 0.788 | 0.0008 | 0.006 | | | | | | | | | |
| 5 | 0.007 | 0.14 | 0.20 | 13.66 | 0.49 | 0.22 | 0.772 | 0.048 | 0.041 | | | | | | | | | |
| 6 | 0.002 | 0.02 | 0.19 | 10.11 | 0.48 | 0.05 | 0.512 | 0.011 | 0.014 | 0.95 | | | | | | | | |
| 7 | 0.003 | 0.02 | 0.19 | 10.05 | 0.48 | 0.06 | 0.522 | 0.011 | 0.015 | | 0.98 | | | | | | | |
| 8 | 0.008 | 0.14 | 0.19 | 15.07 | 1.48 | 0.21 | 0.783 | 0.010 | 0.004 | | | 0.28 | | | | | | |
| 9 | 0.003 | 0.02 | 0.19 | 17.67 | 1.48 | 0.21 | 0.253 | 0.010 | 0.008 | | | | 0.18 | | | | | |
| 10 | 0.002 | 0.15 | 0.19 | 17.48 | 0.33 | 0.21 | 0.788 | 0.009 | 0.004 | | | 0.14 | 0.03 | | | | | |
| 11 | 0.005 | 0.15 | 0.19 | 15.02 | 0.49 | 0.14 | 0.732 | 0.011 | 0.003 | | | | | 0.022 | | 0.003 | | |
| 12 | 0.004 | 0.15 | 0.21 | 13.63 | 0.49 | 0.16 | 0.766 | 0.010 | 0.004 | | | | | | 0.11 | | 0.001 | 0.001 |
| Comparative steel | | | | | | | | | | | | | | | | | | |
| 13 | 0.006 | 0.15 | 0.22 | 13.46 | 0.49 | 0.003 | 0.751 | 0.0002 | 0.014 | | | | | | | | | |
| 14 | 0.008 | 0.14 | 0.22 | 13.63 | 0.49 | 0.092 | 0.736 | 0.0003 | 0.017 | | | | | | | | | |
| 15 | 0.008 | 0.15 | 0.19 | 6.87 | 0.38 | 0.081 | 0.588 | 0.011 | 0.021 | | | | | | | | | |
| 16 | 0.040 | 0.14 | 0.19 | 13.68 | 0.49 | 0.823 | 2.381 | 0.009 | 0.013 | | | | | | | | | |
| 17 | 0.006 | 0.14 | 0.19 | 25.38 | 2.02 | 0.21 | 0.783 | 0.142 | 0.072 | | | | | | | | | |

MM: Mischmetal

TABLE 2

| No. | Cold forging properties: crack limit working ratio (%) | Cold forging properties: deformation resistance (kgf/mm²) | Magnetic properties: $B_1$ G | Magnetic properties: $B_{10}$ G | Magnetic properties: $B_{25}$ G | Magnetic properties: Hc Oe | Corrosion resistance: salt spray test 5% NaCl, 35° C., 90 hr | Corrosion resistance: pitting potential (mV) 3.5% NaCl, 30° C. | Specific resistance μΩ-cm |
|---|---|---|---|---|---|---|---|---|---|
| Acceptable steel | | | | | | | | | |
| 1 | 87 | 75 | 9600 | 12800 | 13700 | 0.60 | ◎ | 185 | 72.0 |
| 2 | 83 | 75 | 9600 | 12700 | 13600 | 0.55 | ○ | 123 | 87.8 |
| 3 | 85 | 75 | 9400 | 12600 | 13500 | 0.44 | ◎ | 168 | 61.4 |
| 4 | 85 | 75 | 7600 | 12800 | 13700 | 0.78 | ◎ | 165 | 72.1 |
| 5 | 85 | 75 | 8500 | 12400 | 13200 | 0.62 | ◎ | 178 | 71.8 |
| 6 | 81 | 76 | 6900 | 12600 | 13700 | 0.68 | ◎ | 158 | 70.4 |
| 7 | 80 | 75 | 6900 | 12600 | 13700 | 0.83 | ◎ | 161 | 71.3 |
| 8 | 82 | 75 | 7600 | 12600 | 13500 | 0.79 | ◎ | 140 | 71.0 |
| 9 | 80 | 77 | 6700 | 12000 | 12400 | 0.80 | ◎ | 143 | 67.8 |
| 10 | 82 | 75 | 6600 | 12100 | 12800 | 0.78 | ◎ | 138 | 73.0 |
| 11 | 85 | 75 | 7600 | 12300 | 13200 | 0.82 | ◎ | 155 | 71.8 |
| 12 | 87 | 73 | 9600 | 12700 | 13600 | 0.55 | ◎ | 161 | 72.2 |
| Comparative steel | | | | | | | | | |
| 13 | 78 | 110 | 2500 | 12800 | 13800 | 1.12 | Δ | 70 | 72.2 |
| 14 | 80 | 83 | 9250 | 12800 | 13600 | 0.62 | ◎ | 160 | 72.0 |
| 15 | 85 | 73 | 7400 | 12100 | 13400 | 0.78 | X | −10 | 78.4 |
| 16 | 68 | 127 | 825 | 11000 | 12600 | 1.72 | X | 33 | 98.6 |
| 17 | 68 | 121 | 3700 | 10500 | 10800 | 1.08 | ◎ | 750 | 81.0 |

Salt spray test
◎: less than 1%
○: 1~5%
Δ: 5~20%
X: more than 20%

As seen from Table 2, the comparative steel No. 13 containing no Ti and B are poor in the cold forging property, magnetic property $B_1$ and corrosion resistance.

In the comparative steel No. 14 containing only Ti, the magnetic properties and corrosion resistance are improved, but the cold forging property, particularly deformation resistance is poor. As shown in FIG. 3, such a steel has a problem that the annealing temperature can not be raised.

In the comparative steel No. 15 not satisfying the lower limit of Cr, the cold workability and magnetic properties are good, but the corrosion resistance is poor.

Since the comparative steel No. 16 contains excessive amounts of C, Ti and Al, the specific resistance is high, but the cold workability (crack limit working ratio, deformation resistance) and magnetic properties are poor.

Since the comparative steel No. 17 is an alloy containing excessive amounts of Cr, B and N, the corrosion resistance and specific resistance are very good, but the crack limit working ratio in the cold working is low and the deformation resistance is high. Furthermore, $B_{25}$ is as low as 11000 G, which causes insufficient suction force when being used in the electronically controlled fuel injection system for automobiles.

On the contrary, the steels No.1-No. 12 according to the invention show the crack limit working ratio of not less than 80% and the low deformation resistance of not more than 80 kgf/mm² and also exhibit $Hc \leqq 1.0$ Oe, $B_1 \geqq 5000$ G and $B_{25} \geqq 12400$ G as magnetic properties and have a pitting potential of not less than 100 mV as a corrosion resistance and a specific resistance of not less than 60 μΩ-cm.

As mentioned above, according to the invention, high cold-forging electromagnetic stainless steels having a fine and uniform structure of crystal grains and possessing not only excellent cold forging property but also good magnetic properties and corrosion resistance can be provided, which are industrially useful as a housing material, a sleeve member or a core material in an electronically controlled fuel injection system for automobiles.

What is claimed is:

1. A high cold-forging electromagnetic stainless steel consisting essentially of not more than 0.02 wt % of C, not more than 0.50 wt % of Si, not more than 0.50 wt % of Mn, 10.0–18.0 wt % of Cr, 0.30–1.50 wt % of Mo, 0.05–0.50 wt % of Ti, 0.30–2.00 wt % of Al, 0.0005–0.05 wt % of B, not more than 0.05 wt % of N and the balance being substantially Fe, wherein the simultaneous presence of Ti and B widens the temperature range showing good magnetic properties and produces fine and uniform crystal grain structure to improve the soft magnetic properties and improves cold forging properties.

2. A high cold-forging electromagnetic stainless steel according to claim 1, wherein said steel further contains at least one of not more than 1.0 wt % of Nb and not more than 1.0 wt % of V.

3. A high cold-forging electromagnetic stainless steel according to claim 1, wherein said steel further contains at least one of 0.03–0.3 wt % of Pb, 0.002–0.03 wt % of Ca, 0.01–0.2 wt % of Se and 0.01–0.20 wt % of S.

4. A high cold-forging electromagnetic stainless steel according to claim 2, wherein said steel further contains at least one of 0.03–0.3 wt % of Pb, 0.002–0.03 wt % of Ca, 0.01–0.2 wt % of Se and 0.01–0.20 wt % of S.

5. A high cold-forging electromagnetic stainless steel according to claim 1, wherein said steel further contains 0.0005–0.01 wt % of REM.

6. A high cold-forging electromagnetic stainless steel according to claim 2, wherein said steel further contains 0.0005–0.01 wt % of REM.

7. A high cold-forging electromagnetic stainless steel according to claim 3, wherein said steel further contains 0.0005–0.01 wt % of REM.

8. A high cold-forging electromagnetic stainless steel according to claim 4, wherein said steel further contains 0.0005–0.01 wt % of REM.

9. A high cold-forging electromagnetic stainless steel according to claim 1, wherein Ti is about 0.1 wt % and B is about 0.01 wt %.

* * * * *